US007681331B2

(12) United States Patent
Bathum

(10) Patent No.: US 7,681,331 B2
(45) Date of Patent: Mar. 23, 2010

(54) SANDALS WITH ADJUSTABLE CENTER POST ASSEMBLIES

(75) Inventor: Dale Bathum, Sammamish, WA (US)

(73) Assignee: Crocs, Inc., Niwot, CO (US)

( * ) Notice: Subject to any disclaimer, the term of this patent is extended or adjusted under 35 U.S.C. 154(b) by 530 days.

(21) Appl. No.: 11/708,852

(22) Filed: Feb. 20, 2007

(65) Prior Publication Data

US 2008/0196269 A1 Aug. 21, 2008

(51) Int. Cl.
*A43B 3/12* (2006.01)

(52) U.S. Cl. ..... 36/11.5

(58) Field of Classification Search ..... 36/11.5, 36/7.5, 7.6, 45

See application file for complete search history.

(56) References Cited

U.S. PATENT DOCUMENTS 5,787,608 A * 8/1998 Greenawalt ..... 36/11.5
5,794,360 A * 8/1998 Bell et al. ..... 36/7.6
6,493,965 B1 12/2002 Bathum
6,904,706 B2 * 6/2005 Jones et al. ..... 36/11.5
7,055,265 B1 6/2006 Bathum et al.
7,103,993 B2 * 9/2006 Sakai ..... 36/11.5
7,464,488 B2 * 12/2008 Jones et al. ..... 36/11.5

* cited by examiner

*Primary Examiner*—Ted Kavanaugh
(74) *Attorney, Agent, or Firm*—Faegre & Benson, LLP

(57) ABSTRACT

Sandals with adjustable post assemblies are disclosed herein. In one embodiment, a sandal can include a sole assembly and a first strap coupled to the sole assembly. The first strap is positioned to engage a forefoot area of a wearer's foot. The first strap includes an aperture proximate to an intermediate portion of the first strap. The sandal also includes an adjustable post assembly extending through the aperture. The post assembly includes a post portion coupled to the sole assembly and one or more flexible second straps projecting from the post portion and configured to be releasably coupled to the first strap. The first strap is movable along at least one of the post portion and the one or more flexible second straps to adjust the position of the first strap relative to the sole assembly for engagement with the wearer's foot.

24 Claims, 4 Drawing Sheets

SANDALS WITH ADJUSTABLE CENTER POST ASSEMBLIES

TECHNICAL FIELD

The present disclosure is directed toward footwear and, more particularly, toward sandal-style footwear.

BACKGROUND

Sandals are becoming increasingly popular for activities such as walking, hiking, running, water sports, golfing, and a variety of other sports related activities. Sandals for such activities are currently available in a wide variety of different styles and shapes. For example, sandals typically include a leather or rubberized sole that can be attached to a wearer's foot by strap(s) extending across one or more portions of the wearer's foot. Sandals are generally classified as either "open-heel" or "closed-heel". "Open-heel" sandals, for example, are typically provided with (a) a single strap that passes over the wearer's foot above the bridge, or (b) a combination of a strap with a center post or "toe-thong" positioned between two of the wearer's toe and extending from a strap over the bridge of the wearer's foot to the sole of the sandal (e.g., "flip-flops" or "thong" sandals). "Closed-heel" sandals typically include a strap or upper portion positioned behind the wearer's heel to support the wearer's foot within the sandal. Both types of sandals generally have an open toe structure.

One concern with many conventional flip-flops or thong-type sandals is that the strap that passes over the front portion of a wearer's foot does not fit correctly. For example, if the front of the wearer's foot is relatively thin, then the strap can be too loose and the wearer's foot can inadvertently slide forward and/or backward, causing chafing or blisters on the sole of the foot and on the skin surfaces under the strap or center post. Likewise, if the wearer's foot is relatively thick then the strap can be too tight, which can also cause chafing and/or blisters on the wearer's foot. Such ill-fitting sandals are uncomfortable if worn for any extended period of time and are generally unsuitable for most outdoor activities or sports.

DETAILED DESCRIPTION

The present disclosure is directed to sandals with adjustable center post assemblies. Many specific details of certain embodiments of the invention are set forth in the following description and in FIGS. 1A-2 to provide a thorough understanding of these embodiments. Well-known structures, systems, and methods often associated with such systems have not been shown or described in detail to avoid unnecessarily obscuring the description of the various embodiments of the invention. In addition, those of ordinary skill in the relevant art will understand that additional embodiments of the invention may be practiced without several of the details described below.

Figure 1A:
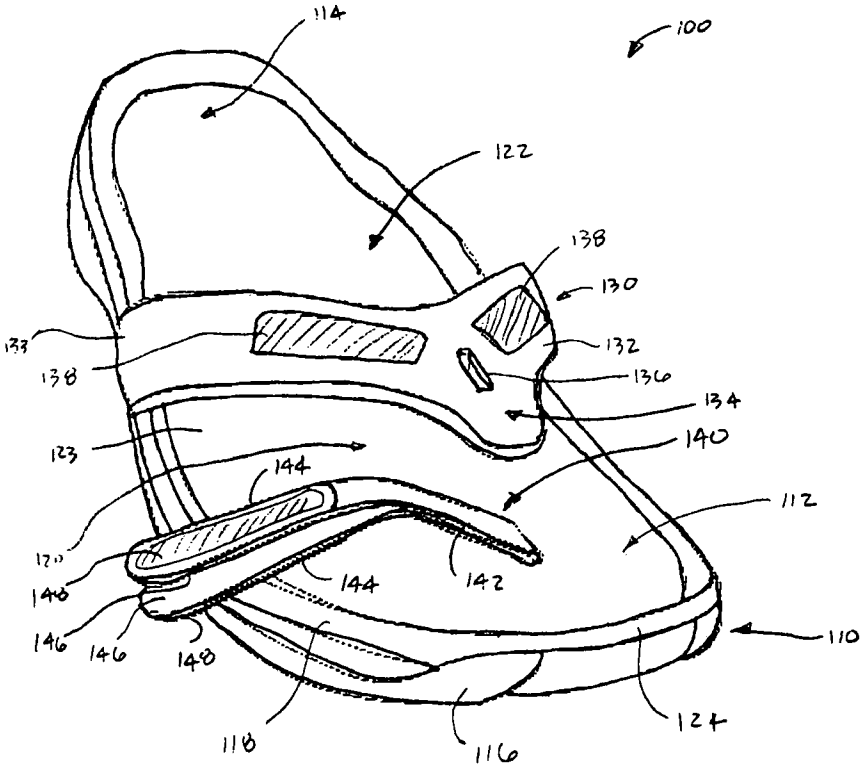
FIG. 1A-1C are isometric views of a sandal including an adjustable center post assembly configured in accordance with an embodiment of the invention.
Figure 1B:
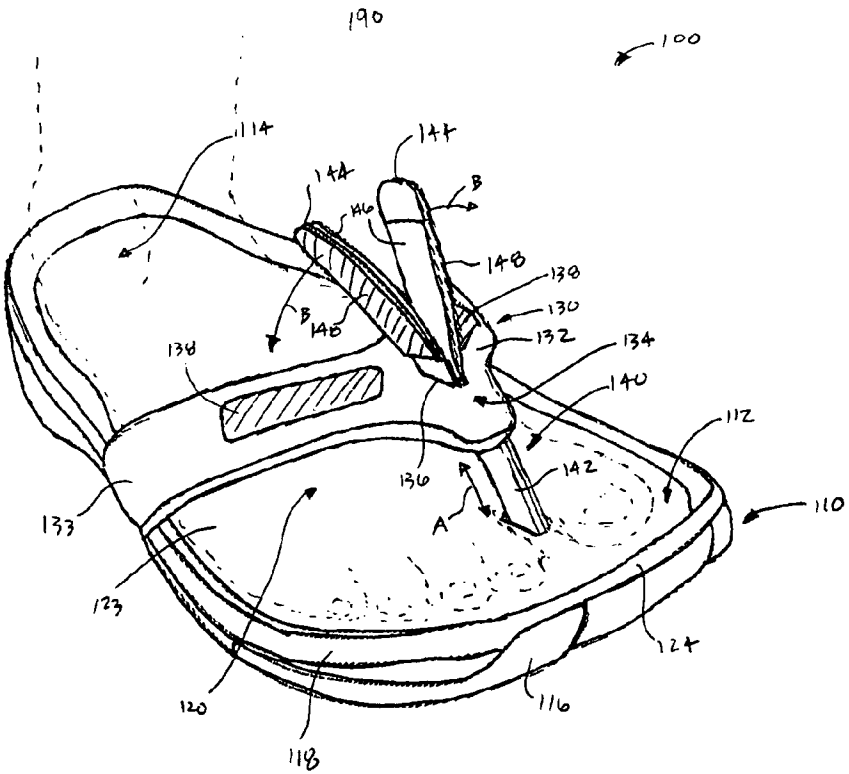
Figure 1C:
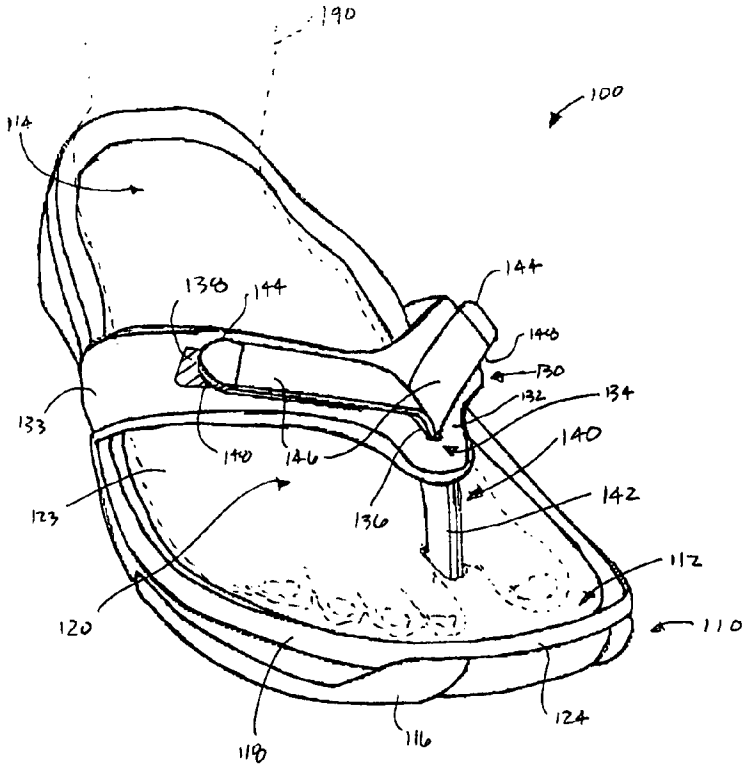

FIGS. 1A-1C are isometric views of a sandal 100 including an adjustable center post assembly 140 configured in accordance with an embodiment of the invention. More specifically, FIGS. 1A-1C illustrate various stages in a method of adjusting the sandal's center post assembly 140 to conform to a wearer's foot. FIG. 1A, for example, is an isometric view of the sandal 100 at a preliminary stage of the method before the wearer's foot is placed in the sandal 100. The sandal 100 includes a sole or base assembly 110, an upper 130 coupled to the sole assembly 110, and the adjustable center post or toe post assembly 140. The sandal 100 includes several features generally similar to the so-called "flip-flops" or thong-type sandals described above (e.g., a generally V-shaped strap that fits over a front portion and side portions of the wearer's foot and a center post or toe post that is fixed to the sandal's sole and generally fits between the wearer's first and second toes. As described in detail below, however, the sandal 100 with the adjustable center post assembly 140 is expected to provide a significantly more comfortable and secure fit as compared with conventional flip-flops or thong-type sandals.

The sole assembly 110 is generally configured to have a profile corresponding to the profile of a plantar surface of a human foot. For example, the sole assembly 110 includes a front portion 112 and a rear portion 114. The front portion 112 corresponds to a wearer's forefoot and toes, while the rear portion 114 corresponds to a wearer's heel area. The sole assembly 110 of the illustrated embodiment further includes an outsole 116, a midsole 118, and an insole 120 with a generally wedge-shaped arch 122. The outsole 116 is adhered to at least a portion of the bottom of the midsole 118. The outsole 116 is configured to provide grip on external surfaces. In several embodiments, for example, the outsole 116 can include variable sized traction lugs (not shown) to provide traction for a variety of different surfaces. The outsole 116 can also include a support component (not shown) including one or more support features, such as an arch shank or stabilizer and/or a heel cup. The outsole 116 can be formed from a single material or a dual-density material (i.e., composed of two or more materials). In one embodiment, the sole assembly includes a contoured cavity in the foot bed area. The cavity is configured to removably receive a selected one of a plurality of interchangeable insoles shaped and sized to fit in the cavity.

The midsole 118 is typically composed of a shock-absorbing material such as Phylon foam, ethylene vinyl acetate (EVA) foam, polyurethane foam, or a combination of materials. (e.g., a dual-density material). The midsole 118 includes a contoured cavity configured to receive and support the insole 120. The insole 120 in the illustrated embodiment includes an interchangeable insole 123 that is tailored to a specific activity (e.g., walking, running, hiking, etc.) and/or a particular foot-type. In other embodiments, however, the sole assembly 110 may include an integral or fixed insole portion rather than the interchangeable insole 123.

The sole assembly 110 can include a toe guard 124 configured to protect the wearer's toes. The toe guard 124 extends from the front of the sole assembly 110. The toe guard 124 can be a fixed or removable component. In other embodiments, the toe guard 124 may not be included. Further details regarding suitable configurations and features for the outsole 116, the midsole 118, the insole 120, and suitable interchangeable insoles 123 that can be used with the sandal 100 are described in U.S. Pat. No. 7,055,265, which is incorporated herein in its entirety by reference. Although the sole assembly 110 is described above as having a midsole and insole, the sole assembly of other embodiments does not need to include a midsole and/or an insole. For example, the sole assembly can be a unitary structure with a bottom surface that engages the ground and a top surface that supports the wearer's foot, or an insole (removeable or non-removeable) that supports the wearer's foot.

The upper 130 includes one or more fixed first straps 132 (only one is shown) connected to the sole assembly 110 and positioned to engage the wearer's foot (not shown). As mentioned previously, the first strap 132 is a generally V-shaped front strap positioned to engage a front and side portions of the wearer's foot. The first strap 132 includes end portions 133 (only one is visible in FIG. 1A) attached to the sole assembly 110 (e.g., the outsole 116). The foot strap 132 also has an intermediate or center portion 134 between the end portions 133 and positioned above the front portion 112 of the sole assembly 110. The intermediate portion 134 of the first strap 132 is adjustably movable relative to the sole assembly 110 and includes (a) an aperture or opening 136 configured to receive the center post assembly 140, and (b) one or more attachment portions 138 (two are shown in the illustrated embodiment) positioned to engage at least a portion of the center post assembly 140, as described in further detail below with reference to FIGS. 1B and 1C. The first strap 132 can be composed of leather, fabric, rubber, a synthetic material, or another suitable material. In several embodiments, for example, the first strap 132 can be formed from the same material as at least a portion of the sole assembly 110. In other embodiments, however, the first strap 132 and the sole assembly 110 can be composed of different materials.

The center post assembly 140 includes a post or body portion 142 fixedly attached to the sole assembly 110 and two flexible second straps 144 projecting from the post 142. In the illustrated embodiment, the post portion 142 is flexible. In other embodiments, however, at least a portion of the post 142 can be generally rigid. The second straps 144 are adjustable straps that each include a first or outer side 146 and a second or inner side 148 configured to releasably engage the corresponding attachment portions 138 on the first strap 132. The second straps 144 (and in some embodiments the post portion 142) can be composed of a fabric, leather, rubber, or synthetic material or another suitable material having sufficient strength to releasably secure the first strap 132 against the wearer's foot.

Referring next to FIG. 1B, the sandal 100 is shown at an intermediate stage of adjusting center post assembly 140 and the first strap 132 after the wearer's foot 190 (shown in broken lines) has been inserted into the sandal 100. In this stage of the method, the flexible post 142 is at least partially received between the wearer's first and second toes and the second straps 144 have been at least partially inserted through the aperture 136 in the first strap 132. More specifically, the second straps 144 (and in some instances, at least a portion of the flexible post 142) have been inserted through the aperture 136 such that the position of the intermediate portion 134 of the first strap 132 can be adjustably moved relative to a top of the wearer's foot 190 along the flexible post 142 (as shown by the arrow A). In this way, the position of the first strap 132 can be adjusted until the first strap 132 is at a desired position relative to the top of the wearer's foot 190. While the adjustment of the first strap 132 and the center post assembly 140 are discussed above when the wearers foot is on the sandal 100, it is to be understood that the first strap 132 and the center post assembly can be adjusted relative to the sole assembly 110 when the wearer's foot is not on the sandal.

After moving the first strap 132 to the desired position, the second straps 144 can be releasably attached to the first strap 132 (as shown by the arrows B) to secure the sandal 100 in place against the wearer's foot 190. More specifically, the second or inner side 148 of the second straps 144 can be releasably fastened or otherwise engaged with corresponding attachment portions 138 on the first strap 132. In the illustrated embodiment, a hook-and-loop material, such as Velcro®, is used to releasably fasten the second straps 144 to the corresponding portions of the first strap 132. In other embodiments, however, fasteners such as snaps, buttons, hooks, clips, ties, or other suitable fasteners may be used to releasably secure the second straps 144 to the first strap 132.

FIG. 1C is an isometric view of the sandal 100 after the second straps 144 have been releasably fastened to the first strap 132. In the illustrated embodiment, for example, the second straps 144 have been pulled through the aperture 136 and attached to the first strap 132 to snugly secure the first strap 132 over the front portion of the wearer's foot, thereby comfortably securing the wearer's foot evenly and firmly into the sandal 100.

One advantage of the sandal 100 including the adjustable center post assembly 140 described above with reference to FIGS. 1A-1C is that the vertical position of the first strap 132 relative to the insole 120 can be adjusted to accommodate a wide range of foot shapes and sizes. Accordingly, the sandal 100 can provide a comfortable fit with many different foot types. Furthermore, the strap system is configured such that adjustments can be performed quickly and easily. Compared with conventional flip-flop or thong-type sandals that provide little or no adjustment, the sandal 100 is expected to provide increased comfort, stability, and support for the wearer.

Figure 2:
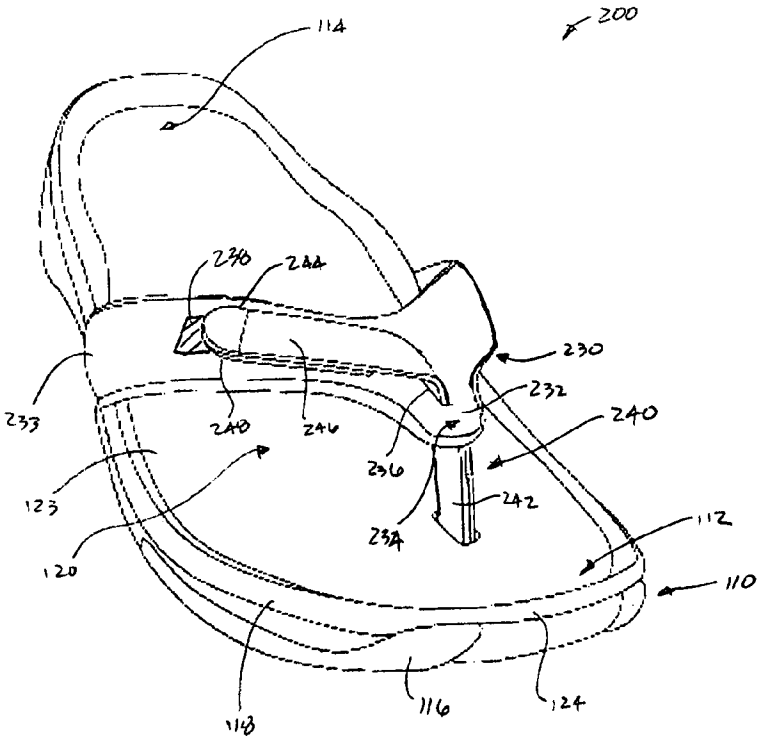
FIG. 2 is an isometric view of a sandal including an adjustable center post assembly configured in accordance with another embodiment of the invention.

FIG. 2 is an isometric view of a sandal 200 including an adjustable center post assembly 240 configured in accordance with another embodiment of the invention. The sandal 200 is generally similar to the sandal 100 described above with reference to FIG. 1A-1C and, accordingly, like reference numbers refer to like components. The sandal 200 differs from the sandal 100, however, in that the sandal 200 includes a center post assembly 240 having a different configuration than the center post assembly 140 of the sandal 100. More specifically, the center post assembly 240 includes a flexible post or body portion 242 attached to the sole assembly 110 and a single adjustable second strap 244 projecting from the post 242, rather than the two second straps 144 of the center post assembly 140. The flexible second strap 244 includes a first or upper side 246 and a second or inner side 248.

The sandal 200 also includes an upper 230 having a first strap 232 with end portions 233 attached to the sole assembly 110 and an intermediate or center portion 234 between the end portions 233. The intermediate portion 234 includes an aperture 236 configured to receive the second strap 244. The first strap 232 also includes an attachment portion 238 positioned to engage at least a portion of the second strap 244. In the illustrated embodiment, for example, the second or inner side 248 of the second strap 244 is releasably fastened or otherwise secured to the attachment portion 238 using materials and/or techniques similar to those described above (e.g., Velcro®, etc.).

From the foregoing, it will be appreciated that specific embodiments of the invention have been described herein for purposes of illustration, but that various modifications may be made without deviating from the invention. For example, the sole assembly 110 can include one or more additional components (e.g., a curved forefoot plate, beveled heel and flex grooves, a fluid drainage system, etc.) and/or one or more components of the sole assembly 110 may be omitted. Furthermore, in other embodiments the first straps 132/232 can include more than a single strap. Aspects of the invention described in the context of particular embodiments may be combined or eliminated in other embodiments. For example, aspects of the invention described in the context of open heel sandals (e.g., flip-flops or thong-type sandals) can be implemented in other types of sandals (e.g., closed heel sandals, sandals designed for particular sport activities, etc.). Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited, except as by the appended claims.

I claim:

1. A sandal for receiving a foot of a wearer, the foot having a forefoot area and a heel area, the sandal comprising:

a sole assembly;

a first strap coupled to the sole assembly and positioned to engage the forefoot area of the foot, the first strap including an aperture proximate to an intermediate portion of the first strap; and a post assembly extending through the aperture, the post assembly including a post portion coupled to the sole assembly and one or more second straps projecting from the post portion, the post assembly being configured to be releasably coupled to the first strap, wherein the first strap is movable along at least one of the post portion and the one or more second straps to adjust the position of the first strap relative to the sole assembly for engagement with wearer's foot.

2. The sandal of claim 1 wherein the post portion is positioned to be received between a first toe and a second toe of the foot.

3. The sandal of claim 1 wherein the one or more second straps are releasably coupled to the first strap using a hook-and-loop material after passing through the aperture.

4. The sandal of claim 1 wherein the first strap includes one or more attachment portions, and wherein the one or more second straps are positioned to releasably engage the corresponding one or more attachment portions to releasably couple the first strap to the post assembly at a desired position relative to the sole assembly.

5. The sandal of claim 1 wherein the post portion of the adjustable center post assembly extends through the aperture.

6. The sandal of claim 1 wherein the post portion coupled to the sole assembly is generally flexible.

7. The sandal of claim 1 wherein the post portion coupled to the sole assembly is generally rigid.

8. The sandal of claim 1 wherein at least a portion of the post assembly is composed of a different material than the sole assembly.

9. The sandal of claim 1 wherein the sole assembly includes a contoured cavity, and wherein the sandal further comprises a plurality of interchangeable insoles shaped and sized to be removably positioned in the contoured cavity.

10. The sandal of claim 9 wherein at least one of the insoles has an aperture therein and the center post extends through the slot in the insole.

11. The sandal of claim 1 wherein the sole assembly includes a flexible midsole, and wherein the sandal further comprises a toe guard coupled to the midsole at a front portion of the sandal.

12. A sandal strap system for releasably securing a foot of a wearer to a sandal having a sole assembly with a foot supporting surface, the sandal strap system comprising:

a foot retention strap coupled to the sole assembly and positioned to engage a forefoot area of the foot, the foot retention strap including an adjustment aperture positioned proximate to an intermediate portion of the foot retention strap; and a post assembly attached to the sole assembly and positioned to be between toes on the wearer's foot, the post assembly extending through the aperture and being adjustably coupled to the foot retention strap, wherein the foot retention strap is movable along the post assembly to tighten or loosen the foot retention strap relative to the wearer's foot.

13. The sandal strap system of claim 12 wherein the post assembly includes (a) a post portion coupled to the sole assembly, and (b) one or more flexible adjustment straps projecting from the post portion and configured to be releasably coupled to the foot retention strap.

14. The sandal strap system of claim 13 wherein the post portion coupled to the sole assembly is a flexible post.

15. The sandal strap system of claim 13 wherein the post portion coupled to the sole assembly is a generally rigid post.

16. The sandal strap system of claim 13 wherein the one or more adjustment straps are releasably coupled to the foot retention strap using a hook-and-loop material after passing through the adjustment aperture.

17. The sandal strap system of claim 12 wherein the post assembly is positioned to engage the wearer's foot between a first toe and a second toe of the foot.

18. The sandal strap system of claim 12 wherein the foot retention strap and at least a portion of the adjustable post assembly are composed of different materials.

19. The sandal strap system of claim 12 wherein the adjustable post assembly is composed of a different material than the sole assembly.

20. The sandal strap system of claim 12 wherein the foot retention strap is composed of leather and the center post assembly is composed of a flexible synthetic material.

21. A method for making a sandal having an adjustable strap system, the method comprising:

coupling a first end portion and a second end portion of a first strap to a sole assembly of the sandal such that the first strap is configured to engage a forefoot area of a foot, the first strap including an aperture proximate to an intermediate portion of the first strap; and attaching a post assembly to the sole assembly and generally aligned with the aperture, the post assembly configured to extend through the aperture, the post assembly including a post portion coupled to the sole assembly and one or more flexible second straps projecting from the post portion and releasably engageable with the first strap.

22. The method of claim 21, further comprising providing a sole assembly including a flexible midsole having a contoured cavity configured to receive a plurality of interchangeable insoles before coupling a first end portion and a second end portion of the first strap to the sole assembly.

23. The method of claim 21 wherein:

coupling a first end portion and a second end portion of a first strap to a sole assembly comprises coupling a first strap composed of a first material; and attaching a post assembly to the sole assembly comprises attaching a post assembly comprised of a second material different than the first material.

24. The method of claim 21 wherein attaching a post assembly to the sole assembly comprises attaching a post assembly composed of a different material than the sole assembly.

* * * * *